US006824668B2

(12) United States Patent
Kim et al.

(10) Patent No.: US 6,824,668 B2
(45) Date of Patent: Nov. 30, 2004

(54) METHOD FOR ELECTROPLATING NI-FE-P ALLOYS USING SULFAMATE SOLUTION

(75) Inventors: Joung Soo Kim, Daejeon (KR); Yun Soo Lim, Daejeon (KR); Seong Sik Hwang, Daejeon (KR); Moohong Seo, Daejeon (KR)

(73) Assignees: Korea Atomic Energy Research Institute, Daejeon (KR); Korea Hydro & Nuclear Power Co., Ltd., Seoul (KR)

( * ) Notice: Subject to any disclaimer, the term of this patent is extended or adjusted under 35 U.S.C. 154(b) by 225 days.

(21) Appl. No.: 10/294,435

(22) Filed: Nov. 13, 2002

(65) Prior Publication Data

US 2003/0178318 A1 Sep. 25, 2003

(30) Foreign Application Priority Data

Mar. 25, 2002 (KR) ..... 10-2002-0016136

(51) Int. Cl.[7] ..... C25D 3/56

(52) U.S. Cl. ..... 205/258; 205/102; 205/104; 205/149; 205/271; 428/679; 428/680; 428/681; 428/935

(58) Field of Search ..... 205/258, 102, 205/104, 149, 271; 428/679, 680, 681, 935

(56) References Cited

U.S. PATENT DOCUMENTS 4,746,412 A * 5/1988 Uchida et al. ..... 205/258

FOREIGN PATENT DOCUMENTS

JP 5190725 7/1993

OTHER PUBLICATIONS

An article entitled, "Electrochemical Characterization of Fe–Ni–P Alloy Electrodeposition", By K. Sheppard K. Sridharan, published (1997), pp. 1198–1206, no month.

An article entitled, "Electrodeposition of Ni–Fe–P Alloy", By Pushpavanam et al., published (1999), pp. 211–214, no month.

* cited by examiner

*Primary Examiner*—Robert R. Koehler
(74) *Attorney, Agent, or Firm*—Bachman & LaPointe, P.C.

(57) ABSTRACT

Disclosed is a method of electroplating a Ni—Fe—P alloy using a sulfamate solution and, in particular, a method of electroplating a Ni—Fe—P alloy using a plating solution containing nickel sulfamate, iron sulfamate, phosphorous acid, and a buffer agent. The method is advantageous in that a residual stress of a deposited layer is very low and has stable mechanical properties, and excellent thermal and corrosion resistance because the deposited layer is obtained by electroplating the Ni—Fe—P alloy using the sulfamate solution useful in a high rate plating process. Furthermore, the method can be applied to various parent metals such as stainless steel, Inconel and iron alloys, and to various fields because the chemical compositions of the deposited layer are readily controlled by varying the concentration of the plating solution.

9 Claims, 5 Drawing Sheets

(a)

(b)

(c)

(d)

METHOD FOR ELECTROPLATING NI-FE-P ALLOYS USING SULFAMATE SOLUTION

TECHNICAL FIELD

The present invention relates to a method of electroplating a Ni—Fe—P alloy using a sulfamate solution and, in particular, to a method of elecrtro-plating a Ni—Fe—P alloy using a plating solution containing nickel sulfamate, iron sulfamate, phosphorous acid, and a buffer agent.

BACKGROUND ART

As well known to those skilled in the art, when the microstructure of a material is controlled at the nano-scale, desirable physical properties such as excellent ductility and hardness can be easily secured. So researches on nano-technologies are active in the material field. In particular, many efforts to use the nano-technology in the automobile and aviation industries have been made to develop nano-particle reinforced light materials, nanoparticle reinforced tires, coating materials not requiring a washing process, fire resistant plastics, electronic control devices, self-healing coatings and fibers and so on. At this time, an electroplating is used in economically producing the nano materials.

Meanwhile, Inconel alloy or stainless steel used as material of steam generator tubes in nuclear power plants fails due to stress corrosion cracking as the operating time increases time, thus requiring frequent repairing. In particular, it is very important to properly repair the failed the steam generator tubes to prevent the leakage of primary cooling water contaminated with radioactive materials in nuclear power plants. The failed steam generator tubes have been repaired using an conventional alloy welding or a laser beam welding processes. However, these processes are induce high thermal residual stress in the parent metal and weld. If the repairing is accomplished by an electroplating process, such problems due to the residual thermal stress can be avoided, thereby desirable repairing the failed steam generator tubes. Accordingly, active researches for electroplating stainless steel or Ni-based Inconel alloys are currently pursued.

The electroplating Ni—P and Ni—Fe alloys among various Ni-based alloys has been highlighted because of their excellent mechanical properties and corrosion resistance and a possibility of being used to produce an excellent magnetic alloy thin film. However, the Ni—P alloy has the disadvantage of poor mechanical properties owing to the rapid grain growth at a temperature of 350° C. or higher, and the Ni—Fe alloy is disadvantageous in that a content of Fe in the Ni—Fe alloy is not easily controlled.

In addition, researches on electroplating the Ni—Fe—P alloy, a ternary alloy of Ni—P and Ni—Fe alloys, has not been done so actively mainly due to complexity and difficulty in controlling the composition of the Ni—Fe—P alloy. Recently, however, the Ni—Fe—P alloy is highlighted because corrosion and thermal resistance are readily improved by desirably controlling Fe content in the Ni—Fe—P alloy, unlike the Ni—P alloy, and the Fe content in the Ni—Fe—P alloy is easily controlled by adding P to the Ni—Fe alloy, unlike the Ni—Fe alloy.

Japanese Pat. No. 5190725 discloses a method of electroplating Ni—Fe—P alloy using a sulfate ($NiSO_4$) solution so as to improve oxidation resistance, and bending property of a semiconductor element and a wire bonding part. Furthermore, Sridharan and Sheppard, and Pushpavanam and Vaijayanthy suggest a method of plating a Ni—Fe—P alloy by a sulfate solution [*J. Applied Electrochemistry*, vol. 29, 1997, p.1198–1206; *Bulletin of Electrochemistry*, vol. 15, no. 5–6, 1999, p.211–214]. However, these methods are disadvantageous in that an electrodeposition stress is high and a plating rate low, thus being poor in economic efficiency. Accordingly, there remains a need to develop an electroplating method having low electrodeposition stress, and excellent thermal resistance, abrasion resistance, and corrosion resistance, and capable of being quickly plated.

The present inventors have conducted extensive studies on the method of electroplating a Ni—Fe—P ternary alloy using a sulfamate solution, resulting in the finding that a electrodeposited layer obtained using the method of the present invention has a very low electrodeposition stress and a plating process is very quickly conducted, thereby securing excellent economic efficiency.

DISCLOSURE OF THE INVENTION

Accordingly, the present invention has been made keeping in mind the above disadvantages occurring in the prior art, and an object of the present invention is to provide a method of electroplating a Ni—Fe—P alloy using a sulfamate solution.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

The present invention provides a method of electroplating Ni—Fe—P alloys using a sulfamate solution. The method comprises the steps of dipping a parent metal into the electroplating solution containing nickel sulfamate ($Ni(SO_3NH_2)_2$), iron sulfamate ($Fe(SO_3NH_2)_2$), phosphorous acid ($H_3PO_3$), and a buffer agent; and electroplating the parent metal under conditions of a constant electric current and temperature.

The said nickel sulfamate, the iron sulfamate, and the phosphorous acid act as sources for supplying Ni, Fe, and P, respectively. The solution comprising of the nickel sulfamate, the iron sulfamate, and the phosphorous acid produces electrodeposion having very low residual stress and acts as an electroplating solution capable of high rate plating. According to the present invention, 1.0 to 2.2 mol/l of nickel sulfamate, 0.002 to 0.9 mol/l of iron sulfamate, and 0.002 to 0.08 mol/l of phosphorous acid are added to the solution. Furthermore, 0.2 to 1.2 mol/l of the buffer agent is added to the solution in order to maintain pH constant, which is one of important electroplating parameters. In the present invention, boric acid ($H_3BO_3$) is used as the buffer agent to maintain the solution in an acidic atmosphere.

Figure 1:
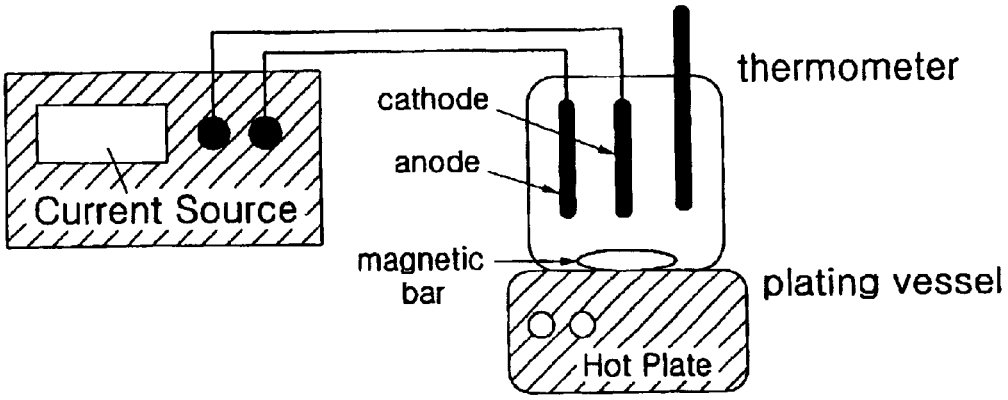
FIG. 1 is outline showing a device for plating a Ni—Fe—P alloy according to the present invention.
Figure 2:
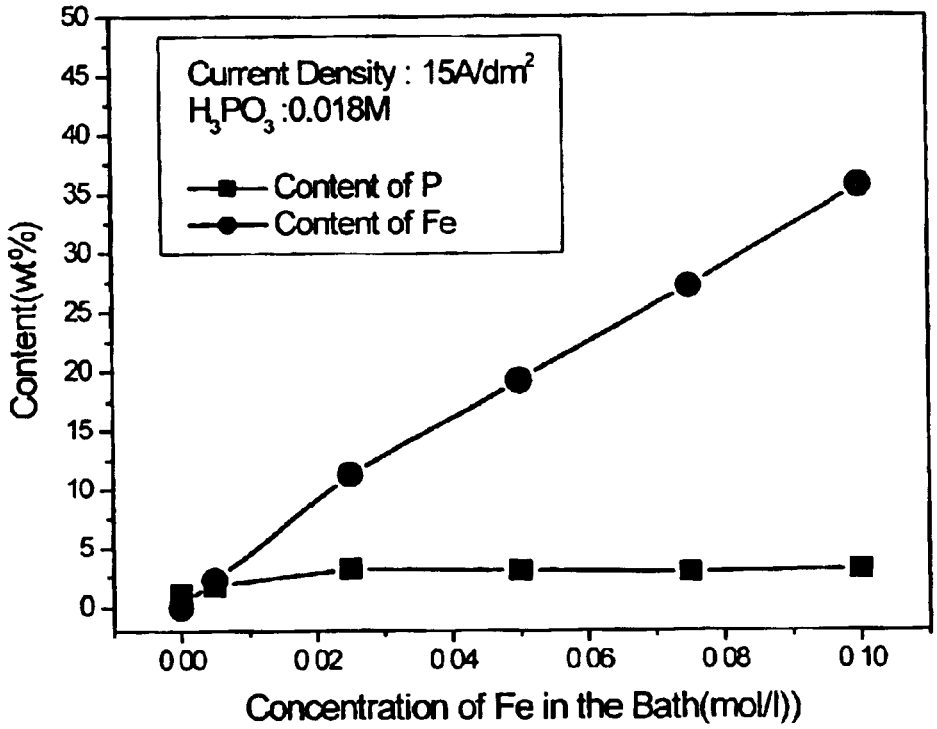
FIG. 2 is a graph showing contents of P and Fe as a function of a concentration of Fe in a sulfamate solution according to the present invention.
Figure 3:
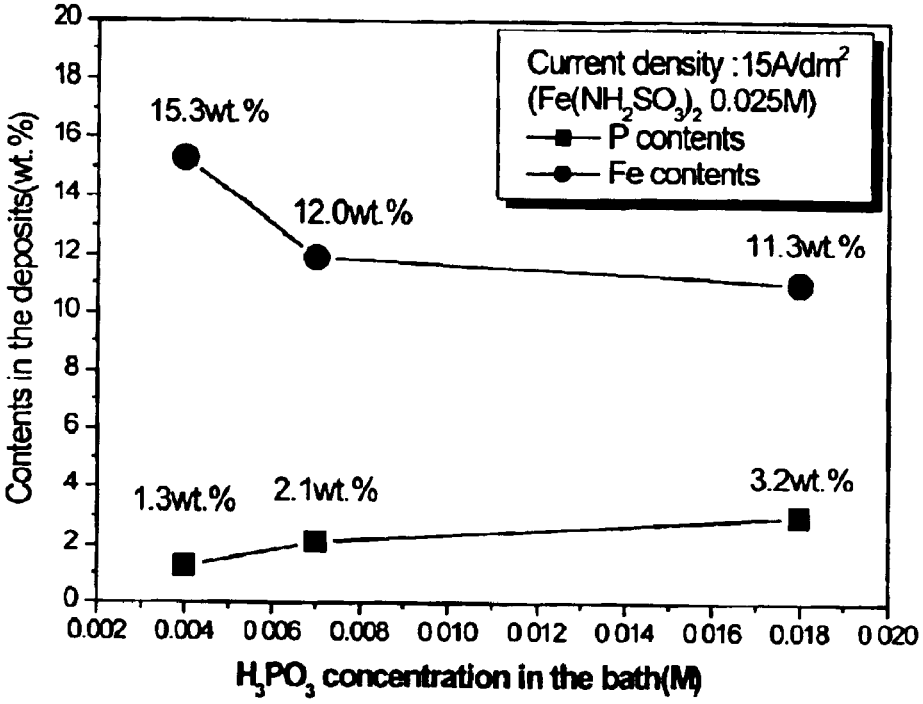
FIG. 3 is a graph showing contents of P and Fe in deposits according to a concentration of phosphorous acid in the sulfamate solution according to the present invention.

With reference to FIGS. 2 and 3, Fe content in a electrodeposition layer increases with the content of iron sulfamate in the plating solution increasing, and the Fe content in the electrodeposition layer reduces but P content increases with the content of phosphorous acid in the plating solution increasing.

Current efficiency can be calculated by dividing total electric charge supplied by the given time period. The current efficient measured shows a minimum value when the amount of iron sulfamate in the plating solution is 0.25 mol/l and increases with increasing the amount of the iron sulfamate from 0.25 mol/l(refer to Table 1).

Figure 4:
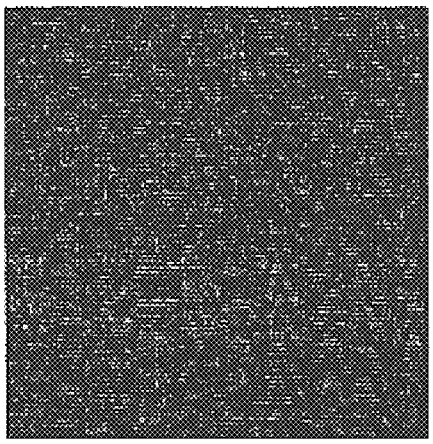
FIGS. 4*a* to 4*d* are SEM micrographs (400 magnification) showing surface structures of the Ni—Fe—P alloy with varying a content of Fe in the deposit.
Figure 4:
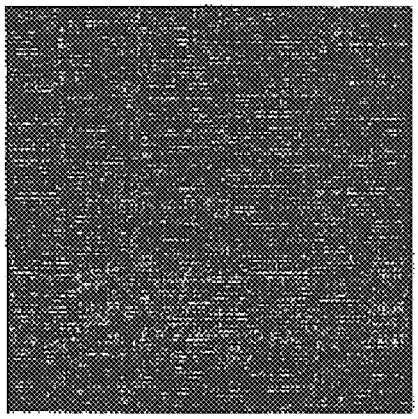
Figure 4:
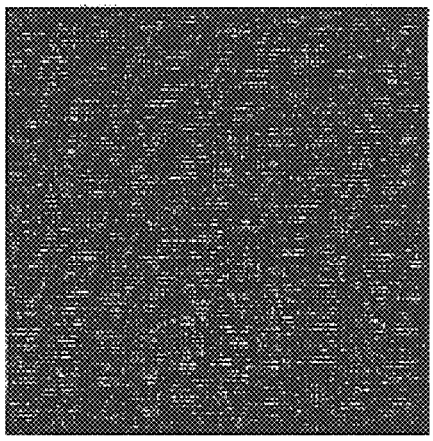
Figure 4:
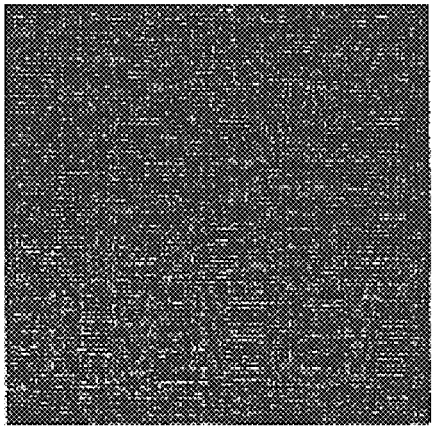
Figure 5:
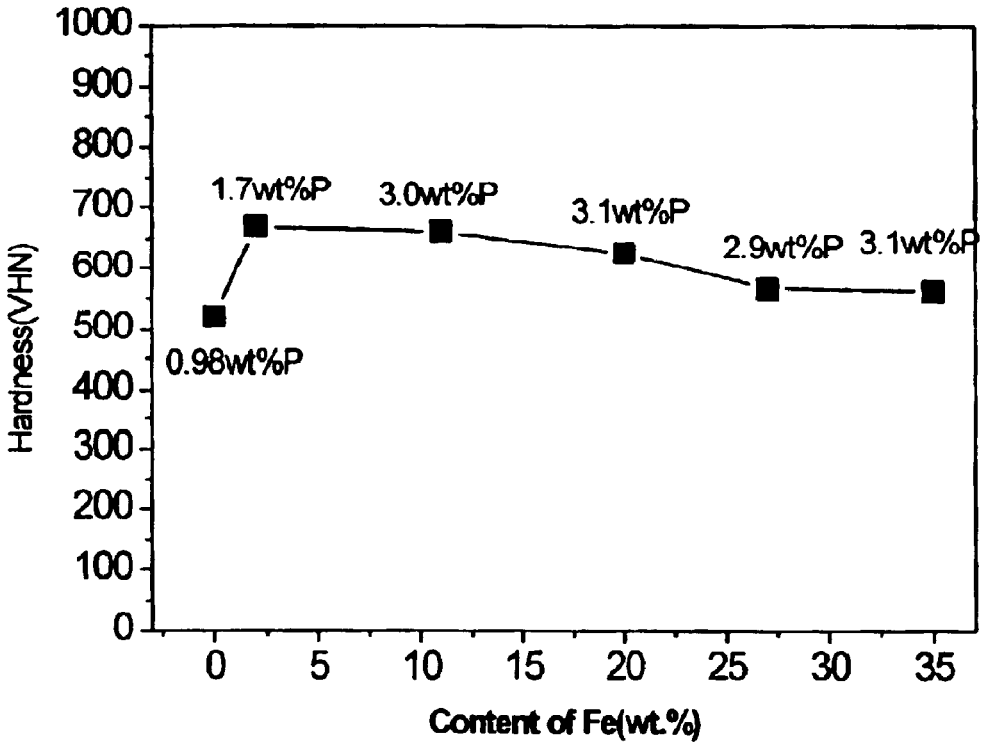
FIG. 5 is a graph showing hardness of the deposit according to a content of Fe in the deposit.

Referring to FIG. 4, the surface roughness of the electrodeposition layer reduces according to increasing content of an iron sulfamate in the electroplating solution. Turning to FIG. 5, the hardness of the electrodeposition layer increases until Fe content in the electrodeposition layer is 2.2 wt %, and then slowly reduces when the Fe content is 2.2 wt % or more. The electrodeposition layer has an excellent hardness of 500 VHN even though the deposited layer is subjected to a thermal treatment at a temperature of 500° C. or higher.

Furthermore, the method of electroplating the Ni—Fe—P alloy, using the sulfamate solution, is conducted under the conditions of an impressed electric current density of 1 to 100 A/dm$^2$, a temperature of 25 to 60° C., and pH 5 or lower. Direct current or pulse current is used as the said impressed electric current within the constant electric current density as mentioned above, and the said pulse current has 5 to 85% duty cycle defined as following equation 1 and a frequency of 10 to 1000 Hz.

$$\theta = \frac{t_{on}}{T} \quad (T = t_{on} + t_{off}) \qquad \text{[Equation 1]}$$

(where, $t_{on}$ is a time during which the electric current is applied to the electroplating solution, $t_{off}$ is a time during which no electric current is applied to the plating solution, and T is a time of one cycle of the pulse current).

The method of plating the Ni—Fe—P alloy further comprises the steps of acid-rinsing the parent metal with 5 to 85% sulfuric acid ($H_2SO_4$) for 5 to 120 sec before the plating step; and forming a nickel strike layer on the parent metal after the acid-rinsing step but before the plating step so as to smoothly grow the deposited layer. The forming step of the nickel strike layer is conducted with the use of a solution comprising of 1 to 3 mol/l of nickel chloride.dihydrate ($NiCl_2.2H_2O$) and 0.2 to 1 mol/l of boric acid under an electric current density of 1 to 20 A/dm$^2$ at a temperature of 25 to 60° C. for 5 to 20 min.

In addition, an electrodeposition stress undesirably increases with the content of an iron sulfamate increasing, but the stress can be reduced by adding a stress reducing agent to the plating solution. The said stress reducing agent preferably consists of saccharine.

Furthermore, the method of electroplating Ni—Fe—P alloy according to the present invention can be applied to various parent metals such as stainless steel, Inconel alloy, and iron alloy. In other words, the method can be applied to various fields because the chemical composition of the electrodeposition layer is easily controlled by varying the concentrations of the plating solution. In detail, a lead frame substrate, stainless steel, the inside of a tube comprising of Inconel alloy, the surface of iron alloy, and the inside of heat transfer tube used in nuclear power plants are plated with the Ni—Fe—P alloy using the above method.

The present invention will be explained with reference to the following examples. However, the following examples are provided only to illustrate the present invention, and the present invention is not limited to them.

EXAMPLE 1

Plating of a Ni—Fe—P alloy 0.65 mol/l of boric acid was added as a buffer agent to a plating solution containing a 0.39 mol/l of nickel sulfamate, 0.005 mol/l of iron sulfamate, and 0.018 mol/l of phosphorous acid. A stainless steel plate was plated with a Ni—Fe—P alloy in a plating vessel with a volume of 1 liter in conjunction with an agitation using a magnetic bar at 50° C. to form a bath. At this time, a platinum-plated titanium was positioned at an anode and the stainless steel plate to be plated was positioned at a cathode. Direct current with an average density of electric current of 15 A/dm$^2$ was applied to the said bath(pH=1) at a constant temperature of 50° C.

An electrodeposition method was conducted for 1 hour to form an electrodeposition layer with a thickness of 100 to 150 $\mu$m. A content of Fe in the electrodeposition layer was 2.2 wt % and a content of phosphorous was 1.7 wt %. At this time, an electrodeposition stress of the deposited layer was very low; 5 kg/mm$^2$ or less. The residual stress of the electrodeposition layer was increased with the content of iron sulfamate increasing, and decreased by adding a stress reducing agent such as saccharine to the plating solution.

EXPERIMENTAL EXAMPLE 1

Composition of Fe and P in an Electrodeposition Layer According to a Concentration of Iron Sulfamate A plating solution containing 0.39 mol/l of nickel sulfamate and 0.018 mol/l of phosphorous acid was prepared in a plating vessel with a volume of 1 liter, and 0.65 mol/l of boric acid was added as a buffer agent to the plating solution. The resulting mixture was agitated with the use of a magnetic bar at 50° C. to form a homogenous solution. Stainless steel plate was plated with a Ni—Fe—P alloy while an amount of iron sulfamate added to the bath is varied from 0 to 0.1 mol/l. At this time, a platinum-plated titanium was used as an anode and the stainless steel plate to be plated was used as a cathode. Direct electric current with an average density of 15 A/dm$^2$ was applied to the said solution(pH=1) at a constant temperature of 50° C. Chemical compositions of the resulting electrodeposition layer were analyzed by an ICP method (Inductively Coupled Plasma), and the results are plotted in FIG. 2.

As shown in FIG. 2, it can be seen that P content is almost unchanged while Fe content increases with the concentration of iron sulfamate increasing.

EXPERIMENTAL EXAMPLE 2

Compositions of Fe and P in an Electrodeposition Layer According to a Concentration of Phosphorous Acid A plating solution containing 0.39 mol/l of nickel sulfamate and 0.025 mol/l of iron sulfamate was prepared in an electroplating vessel with a volume of 1 liter, and 0.65 mol/l of boric acid was added as a buffer agent to the plating solution. The resulting mixture was agitated with the use of a magnetic bar at 50° C. to form a homogenous solution. A stainless steel plate was plated with a Ni—Fe—P alloy while an amount of phosphorous acid added to the solution is varied from 0.004 to 0.018 mol/l. At this time, a platinum-plated titanium was used as an anode and the stainless steel plate to be plated was used as a cathode. Direct current with an average density of electric current of 15 A/dm$^2$ was applied to the said solution(pH=1) at a constant temperature of 50° C. Chemical compositions of the resulting electrodeposition layer were analyzed by an ICP method, and the results are plotted in FIG. 3.

As shown in FIG. 3, it can be seen that P content increases from 1.3 to 3.2 wt % while Fe content decreases from 15.3 to 11.3 wt % with a concentration of phosphorous acid increasing from 0.004 to 0.018 mol/l.

EXPERIMENTAL EXAMPLE 3

Measurement of a Current Efficiency Varying According to a Concentration of Iron Sulfamate An experiment was conducted to measure a current efficiency indicating how much of a total supplied electric charge calculated with flowed electric current and elapsed time was used to plate a stainless steel plate in a given time period.

The stainless steel plate was plated according to the same bath and procedure as experimental example 1 while iron sulfamate is added to the bath in an amount of 0, 0.025, 0.050, 0.075, and 0.100 mol/l. An alloy ratio of the resulting electrodeposition layer was analyzed by an ICP method, and a current efficiency (%) was calculated using the chemical compositions of the alloy and Faraday's law. The results are described in Table 1, below.

TABLE 1

A current efficiency and chemical compositions of an electrodeposition layer varying according to a content of iron sulfamate

| Iron sulfamate (mol/l) | Current efficiency (%) | Alloy ratio (Ni/Fe/P %) |
|---|---|---|
| 0 | 83 | (remained/0.0/0.98) |
| 0.025 | 50 | (remained/11.3/3.2) |
| 0.050 | 60 | (remained/19.2/3.0) |
| 0.075 | 63 | (remained/27.1/2.9) |
| 0.100 | 70 | (remained/35.6/3.1) |

As shown in Table 1, it can be seen that the current efficiency is a minimum 50% when a concentration of iron sulfamate is 0.025 mol/l and the current efficiency is increased when the concentration of iron sulfamate is increased to not less than 0.025 mol/l.

EXPERIMENTAL EXAMPLE 4

Measurement of a Surface Structure and a Hardness of a Ni—Fe—P Alloy Varying According to a Content of Fe Surfaces of the electrodeposition layers plated in said experimental example 1 and 2 were photographed by SEM at 400 magnifications, and the hardness of the electrodeposition layer was obtained by measuring a depth of an indenter using a hardness tester. Micrgraphs of the surface structures of the electrodeposition layers are illustrated in FIG. 4, in which (a) is a SEM micrograph showing the surface structure of the Ni-0.98 wt % P alloy, (b) is a SEM micrograph showing the surface structure of the Ni-2.2 wt % Fe-1.7 wt % P alloy, (c) is a SEM micrograph showing the surface structure of the Ni-27.1 wt % Fe-2.9 wt % P alloy, and (d) is a SEM micrograph showing the surface structure of the Ni-35.6 wt % Fe-3.1 wt % P alloy. In addition, the results of the hardness are plotted in FIG. 5.

As shown in FIG. 4, it can be seen that a surface roughness of the electrodeposition layer is reduced when Fe content in the electrodeposition layer is increased from 0.98 wt % to 35.6 wt %, thus obtaining a smooth surface of the electrodeposition layer.

As shown in FIG. 5, the hardness increases until the Fe content is 2.2 wt % and slowly reduced when the Fe content is not less than 2.2 wt %. Hardness increases until the P content is 1.7 wt % and reduced when the P content is not less than 1.7 wt %. Furthermore, the electrodeposition layer shows a excellent hardness of 500 VHN even though the electrodeposition layer is subjected to a thermal treatment at a temperature of 50° C. or higher.

INDUSTRIAL APPLICABILITY

As disclosed hereinbefore, the method of electroplating a Ni—Fe—P alloy using a plating solution containing nickel sulfamate, iron sulfamate, phosphorous acid, and a buffer agent enables to reduce the residual stress of a electrodeposition layer, conduct electroplating with high rate, and prepare electrodeposition layer of stable mechanical properties. Also, the said method enables electroplated alloys to be excellent thermal and corrosion resistant, economically. Furthermore, the said method can be applied to various parent metals such as stainless steel, Inconel alloy and iron alloy. Further, the said method is applied to various fields because chemical compositions of the electrodeposition layer are readily controlled by varying the concentration of the plating solution.

What is claimed is:

1. A method of electoplating a Ni—Fe—P alloy, comprising the steps of:

dipping a parent metal into a electroplating solution containing nickel sulfamate ($Ni(SO_3NH_2)_2$), iron sulfamate ($Fe(SO_3NH_2)_2$), phosphorous acid ($H_3PO_3$), and a buffer agent; and plating the parent metal under conditions of an electric current density of 1 to 100 A/dm$^2$, a temperature of 25 to 60° C., and pH of less or equal to 5.

2. The method according to claim 1, wherein the plating solution contains 1.0 to 2.2 mol/l of the nickel sulfamate, 0.002 to 0.9 mol/l of the iron sulfamate, 0.002 to 0.08 mol/l of the phosphorous acid, and 0.2 to 1.2 mol/l of the buffer agent.

3. The method according to claim 1, wherein the buffer agent consists of boric acid ($H_3BO_3$).

4. The method according to claim 1, wherein the electric current is a direct current, or a pulse current with 5 to 85% duty cycle being defined as equation 1 below and a frequency of 10 to 1000 Hz within the current density range:

$$\theta = \frac{t_{on}}{T} \quad (T = t_{on} + t_{off}) \qquad \text{[Equation 1]}$$

(wherein, $t_{on}$ is a time during which the electric current is applied to the plating solution, $t_{off}$ is a time during which no electric current is applied to the plating solution, and T is a time of one cycle of the pulse current).

5. The method according to claim 1, further comprising the step of acid-rinsing the parent metal with 5 to 85% sulfuric acid ($H_2SO_4$) for 5 to 120 sec before the plating step.

6. The method according to claim 5, further comprising the step of forming a nickel strike layer on the parent metal after the acid-rinsing step but before the plating step.

7. The method according to claim 6, wherein the forming step of the nickel strike layer is conducted with the use of a solution comprising of 1 to 3 mol/l of nickel chloride.dihydrate ($NiCl_2.2H_2O$) and 0.2 to 1 mol/l of boric acid under an electric current density of 1 to 20 $A/dm^2$ at a temperature of 25 to 60° C. for 5 to 20 min.

8. The method according to claim 1, wherein the plating solution further contains 1 to 20 mol/l of saccharine.

9. A method of plating a lead frame substrate, stainless steel, the inside of a tube consisting of an Inconel alloy, a surface of an iron alloy, and an inside of a heat transfer tube of a steam generator used in an nuclear power plant using the method of claim 1.

* * * * *

UNITED STATES PATENT AND TRADEMARK OFFICE

CERTIFICATE OF CORRECTION

PATENT NO. : 6,824,668 B2
DATED : November 30, 2004
INVENTOR(S) : Joung Soo Kim et al.

It is certified that error appears in the above-identified patent and that said Letters Patent is hereby corrected as shown below:

Column 8,
Line 3, "chloride.dihydrate" should be corrected to -- chloride•dihydrate --.
Line 4, "($NiCl_2.2H_2O$)" should be corrected to -- $NiCl_2$•$2H_2O$) --.

Signed and Sealed this

Seventeenth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,824,668 B2
DATED : November 30, 2004
INVENTOR(S) : Joung Soo Kim et al.

It is certified that error appears in the above-identified patent and that said Letters Patent is hereby corrected as shown below:

Column 8,
Line 3, "chloride.dihydrate" should be corrected to -- chloride•dihydrate --.
Line 4, "($NiCl_2.2H_2O$)" should be corrected to -- $NiCl_22H_2O$) --.

This certificate supersedes Certificate of Correction issued May 17, 2005.

Signed and Sealed this

Twenty-first Day of March, 2006

JON W. DUDAS
*Director of the United States Patent and Trademark Office*